US006047739A

United States Patent [19]

Nixon

[11] Patent Number: 6,047,739

[45] Date of Patent: Apr. 11, 2000

[54] REMOVABLE COVER FOR THE OUTLET OF A VERTICALLY-ORIENTED EXHAUST PIPE

[76] Inventor: Kurtis D. Nixon, 5817 Appaloosa Pl., Rocklin, Calif. 95677

[21] Appl. No.: 09/123,099

[22] Filed: Jul. 27, 1998

[51] Int. Cl.[7] ..... F16L 55/10; F16L 11/00; B65D 59/00

[52] U.S. Cl. ..... 138/89; 138/96 R; 138/110

[58] Field of Search ..... 138/110, 89, 96 R

[56] References Cited

U.S. PATENT DOCUMENTS

| | | | |
|---|---|---|---|
| 4,375,352 | 3/1983 | Berry et al. | 431/8 |
| 4,742,766 | 5/1988 | Davison et al. | 98/59 |
| 4,936,351 | 6/1990 | Wells et al. | 138/96 R |
| 5,687,773 | 11/1997 | Ryan et al. | 138/110 |

*Primary Examiner*—Andres Kashnikow

*Assistant Examiner*—Davis Hwu

*Attorney, Agent, or Firm*—Heisler & Associates

[57] ABSTRACT

A cover 10 for an outlet O of a vertically-oriented exhaust stack S is provided. The cover 10 includes a cylindrical sleeve 20 with a convex cap portion 30. The cap portion 30 includes a lip 35 to provide a means to grasp the cover 10 during installation or removal. An inverted circumferential ridge 40 depends from the lip 35 to form a channel 50 and provide a latching profile to mate with a separate latching lug 60. The latching lug 60 is attached to a distal end 84 of a telescoping pole 80. With the latching lug 60 engaged with the ridge 40 and channel 50, the telescoping pole 80 is extended to raise the cover 10 over the top the outlet of an exhaust stack S. The cover 10 is then lowered onto the exhaust stack S and the latching lug 60 disengaged. Once installed, the cover 10 prevents entry of unwanted matter or debris into the exhaust outlet O of the top of the exhaust stack S.

5 Claims, 3 Drawing Sheets

REMOVABLE COVER FOR THE OUTLET OF A VERTICALLY-ORIENTED EXHAUST PIPE

FIELD OF THE INVENTION

The present invention relates to covers for combustion engine exhaust pipes. More particularly, this invention relates to removable covers for exhaust outlets of vertically-oriented combustion engine exhaust pipes, such as exhaust stacks found on trucks with diesel engines.

BACKGROUND OF THE INVENTION

Unlike automobiles that have horizontally-oriented exhaust pipes, large trucks with diesel engines typically have vertically-oriented exhaust pipes known as exhaust stacks. A diesel exhaust stack is vertically-oriented so that heavy, noxious and smoky diesel engine fumes (and combustion products) are exhausted at an elevation above surrounding traffic to minimize annoyance to other drivers. As a result of the stack's vertical orientation, the opening or exhaust outlet at the top of the exhaust stack is generally exposed and more likely to have rain, leaves, bird droppings or other unwanted matter inadvertently fall into the outlet of the stack. This problem is amplified when the diesel engine is not running. When the diesel engine is running, any debris is hopefully repelled or dispelled by the exhaust flow. Without exhaust flow, nothing prevents the debris from falling into the exhaust stack.

To combat the tendency for debris to easily fall into a vertical exhaust stack, many diesel engine exhaust stacks are designed to terminate in a bend. This bend changes the orientation of the exhaust outlet from a horizontal to a vertical plane. However, a curved exhaust stack may still become plugged by debris or rain, particularly when the truck is not moving and the wind drives rain and debris at an angle to vertical.

Other methods have been used to address the problem of unwanted debris falling into a vertical diesel exhaust stack. One prior art product, commonly known as a clapper, includes a hinged, spring-loaded lid that covers the top of an exhaust stack whenever the diesel engine is not operating. The hinge spring tension is adjusted to allow the clapper lid to open whenever exhaust pressure is present i.e., the diesel engine is running. Unfortunately, clapper covers are not fail-safe. If the spring tension is too low, the clapper may fail in an open position, providing no protection whatsoever. Additionally, if the spring tension is excessive, the clapper may not open sufficiently when the diesel engine is running. As a result, increased back pressure is placed on the diesel engine combustion chamber, negatively affecting engine performance and creating difficulties when attempting to start the engine.

A further limitation of the clapper type cover is its fixed spring constant in its hinge spring. Given a fixed spring constant, the clapper type cover will open and close as the exhaust pressure at the outlet of exhaust stack varies. This open and closing action is particularly noticeable when the engine is at idle or low RPM. During this state, the exhaust pulse is more noticeable, creating a cyclic rather than continuous exhaust flow and outlet pressure. The opening and closing action can create substantial noise as the clapper cyclically slams shut on the top of the exhaust pipe. The resulting clapping noise is extremely annoying to the truck operator.

Accordingly, a need exists for a simple and expedient means to cover the exhaust outlet of a vertically-oriented exhaust pipe or stack to prevent inadvertent entry of unwanted debris or fluids when the truck is at rest.

SUMMARY OF THE INVENTION

The present invention provides a simple and expedient means to cover the opening of a vertically-oriented exhaust stack to prevent entry of unwanted debris while the engine is not operating. The covering means includes a sleeve that can easily slide over the top of a vertically-oriented exhaust stack. Peripheral walls of the sleeve extend sufficiently over the exhaust stack outlet to occlude the outlet.

Typically, vertically-oriented exhaust stacks extend above the top of the cab of a diesel tractor-trailer rig. The extension places the exhaust outlet at a reasonably sufficient elevation to discharge diesel exhaust gases and fumes above neighboring vehicles to prevent annoyance and visual disturbance. Thus elevated, the top of the vertical exhaust stack is unreachable without some form of assistance.

The cover of the present invention is installed and removed using a lightweight telescoping pole. The cover includes a lip to ease installation and removal of the sleeve from the exhaust stack. A distal end of the pole opposite a handle end which includes a means to grasp the lip of the cover. The cover is installed by first engaging the grasping means attached to the distal end of the telescoping pole with the lip of the cover. The pole is then extended to place the cover over the opening at the top of the exhaust stack. Then, the cover is lowered to rest on the top of the stack thereby occluding the exhaust outlet. The grasping means is then disengaged from the lip of the cover. The cover is removed by simply reversing the procedure. Hence, a tractor-trailer driver may quickly and easily install or remove the cover of the present invention whenever stopping his vehicle during rain or when parking for an extended period of time, e.g., overnight.

OBJECTS OF THE INVENTION

Accordingly, it is a primary object of the present invention to provide a removable cover to close off the exhaust outlet at the top of a vertically-oriented exhaust stack when the engine is not running to prevent unwanted entry of debris, water or other matter.

Another object of the present invention is to provide a cover that can be easily installed and removed.

Another object of the present invention is to provide a cover that can fit the majority of existing vertically-oriented exhaust stacks.

Another object of the present invention is to provide a cover that can be installed or removed without using a ladder or other climbing device to reach the top of the exhaust stack.

Another object of the present invention is to provide a set of covers which nest together to save storage space within a cab of the truck when not in use.

Another object of the present invention is to provide a cover of simple and reliable manufacture from commonly available materials.

Other further objects of the present invention will become apparent from a careful reading of the included drawing figures, the claims and detailed description of the invention.

DESCRIPTION OF THE PREFERRED EMBODIMENT

Figure 5:
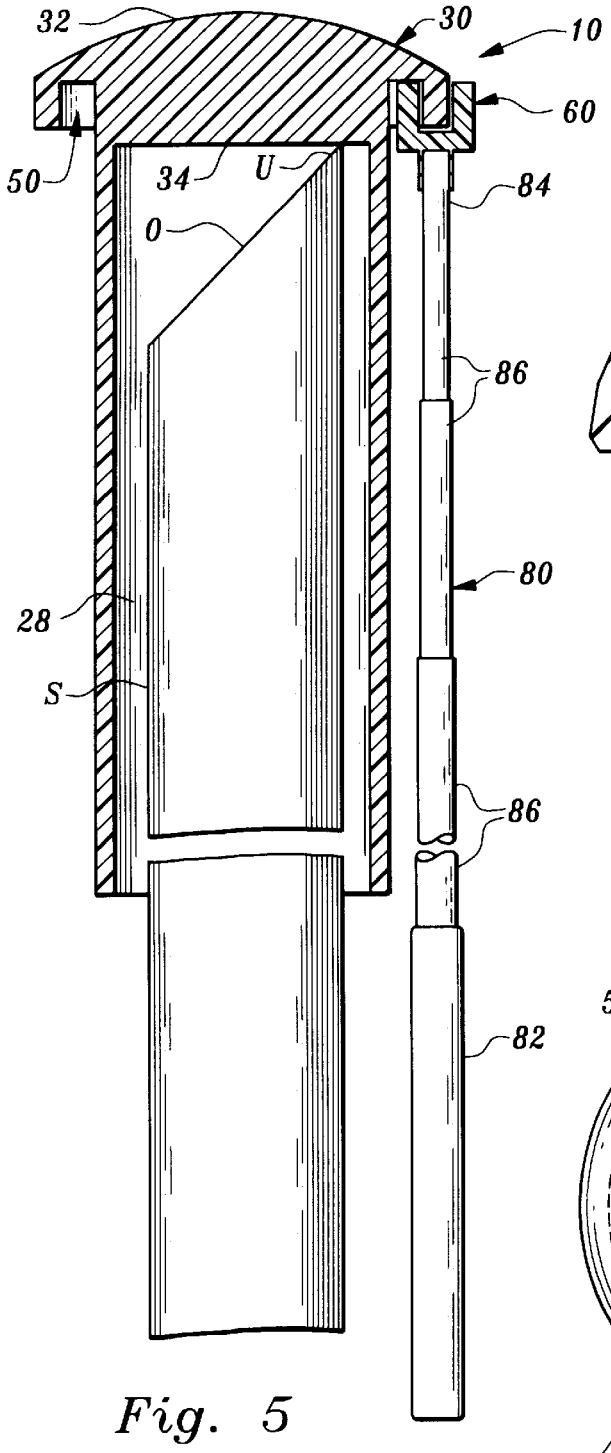
FIG. 5 is a side cross-sectional view of the cover of the present invention installed on top of an exhaust pipe with the telescoping rod engaged with the cover.

Referring to the drawings, wherein like reference numerals represent like parts throughout the various drawing figures, reference numeral 10 is directed to a cover (FIG. 1) for protecting and covering the outlet O of a vertically-oriented engine exhaust stack S (FIG. 5). The stack S is a cylindrical length of pipe used to conduct engine combustion products away from an engine's combustion chamber to discharge the combustion products at a less intrusive location. The cover 10 includes a cylindrical sleeve 20. The sleeve 20 has a sufficient bore B to slidably enclose the outlet O and upper end U of the exhaust stack S.

Figure 1:
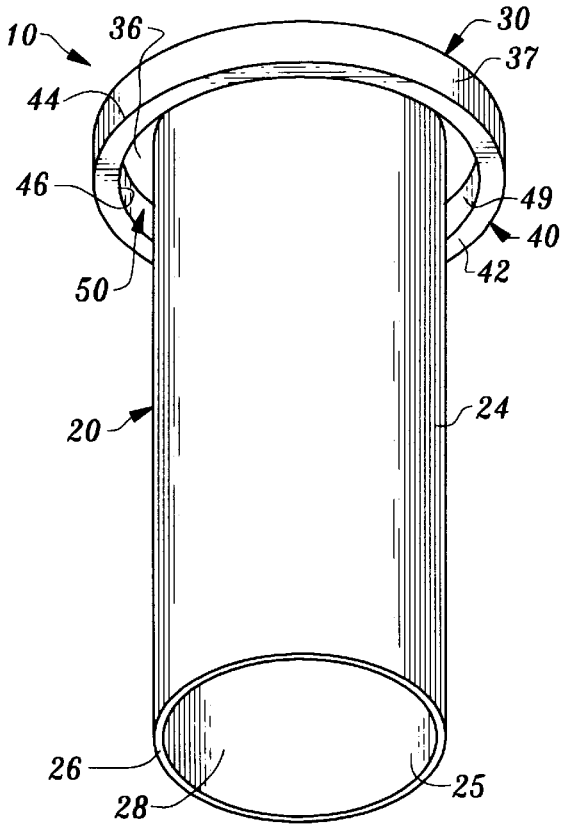
FIG. 1 is a perspective view of the cover of the present invention.
Figure 3:
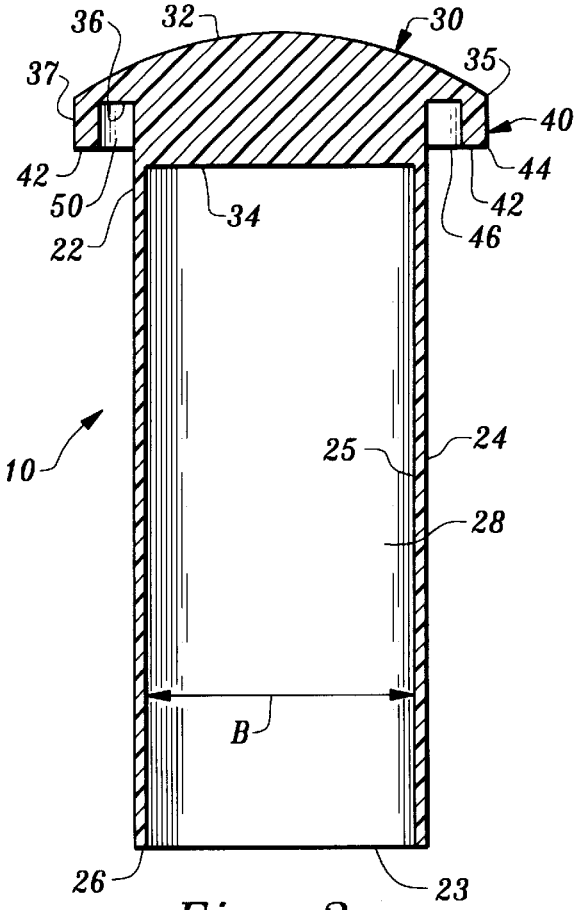
FIG. 3 is a side cross-sectional view of the cylindrical cover of the present invention.
Figure 2:
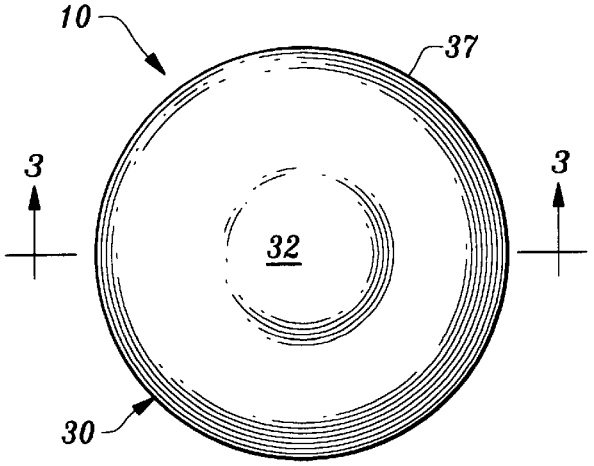
FIG. 2 is a top plan view of the cylindrical cover of the present invention.
Figure 6:
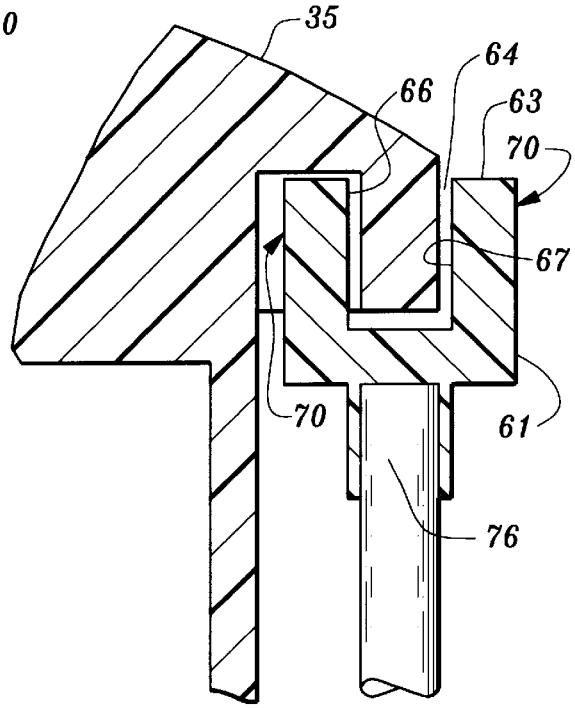
FIG. 6 is a blow up of a portion of that same view shown in FIG. 5 illustrating the detail of the latching profile and engaged latching lug.

In essence, and with particular reference to FIGS. 1 and 6, the basic details of the present invention are described. The cover 10 includes a cylindrical sleeve 20. An integral cap portion 30 covers one end of the sleeve 20. The cap portion 30 includes a lip 35 with an inverted ring-shaped ridge 40 and circumferential channel 50. The ridge 40 and channel 50 form a latching profile to provide a means for engagement of a latching lug 60 with two prongs 70. The latching lug 60 is attached to a telescoping pole 80. The latching lug 60 engages the lip 35 of the cap portion 30 of the cover 10. The telescoping pole 80 allows the cover 10 to be easily installed on and removed from the exhaust stack outlet O.

More particularly, and with initial reference to FIGS. 1–4, the details of the preferred embodiment of the cover 10 are described. The cover 10 includes an elongate cylindrical sleeve 20. The sleeve 20 has a first closed end 22 and an opposing second open end 23. An exterior cylindrical surface 24 and a concentric inner cylindrical surface 25 form a peripheral wall 26 of the sleeve 20. The peripheral wall 26 has a lower edge 27 at the second open end 23 of the sleeve 20. The peripheral wall 26 surrounds and defines a central region 28 of the sleeve 20 with sufficient bore B to slidably receive and fit over the upper end U of the exhaust stack S.

An integral contiguous rigid cap portion 30 adjoins and occludes the first closed end 22 of the sleeve 20. The cap portion 30 provides one form of a means to substantially enclose one end of the central region 28 of the sleeve 20. Other means include forming the peripheral wall 26 of the sleeve 20 to be conically-shaped or joined at a top of the peripheral wall 26 and a flexible membrane adjoined to and covering the closed end 22 of the sleeve 20. The cap portion 30 has a roof 32 which is preferably convex to naturally shed rain and debris from the cover 10. A lower horizontal internal surface or ceiling 34 of the cap portion 30 faces the central region 28 of the sleeve 20. The ceiling 34 faces toward the open end 23 of the sleeve 20, establishing an upper interior surface and limit of the central region 28 of the sleeve 20.

The diameter of the cap portion 30 of the cover 10 is preferably greater than the diameter of the peripheral wall 26 of the sleeve 20 to form a radially-extending lip 35 about the peripheral wall 26 of the sleeve 20 adjacent the first closed end 22 of the sleeve 20. The lip 35 includes a lower surface 36 which extends perpendicularly from the exterior surface 24 of the sleeve 20 about the circumferential periphery of the closed end 22 of the sleeve 20. A peripheral rim 37 of the cap portion 30 is formed by the intersection of the roof 32 of the cap portion 30 with the lower surface 36 of the lip 35.

An inverted circumferential ridge 40 depends from the lower surface 36 of the lip 35 of the cap portion 30, along the rim 37. The inverted ridge 40 is ring-shaped with a preferably rectangular cross-section. The inverted ridge 40 includes a planar crest 42 which is parallel to and beneath the lower horizontal surface 36 of the lip 35. An outer edge 44 and an inner edge 46 define the circumferential boundaries of the planar crest 42 of the inverted ridge 40.

A vertical interior wall 49 connects the inner edge 46 of the planar crest 42 to an approximate median of the lower surface 36 of the lip 35 of the cap portion 30. The interior wall 49 is concentrically parallel to the exterior surface of the sleeve 20. The inverted ridge 40 has a constant thickness as it extends down from the lip 35 and as it extends around the sleeve 20.

Figure 4:
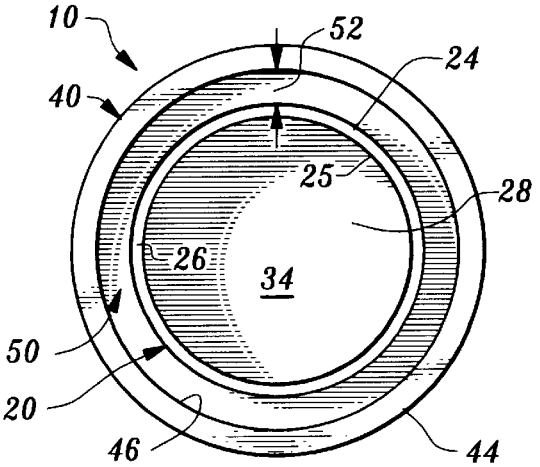
FIG. 4 is a bottom plan view of the cover of the present invention.

The interior wall 49 of the inverted ridge 40 has a circumference greater than the circumference of the exterior surface 24 of the peripheral wall 26 of the sleeve 20. The interior wall 49 of the inverted ridge 40, in combination with the exterior surface 24 of the peripheral wall 26 of the sleeve 20 and the lower surface 36 of the lip 35 of the cap portion 30, form an inverted rectangular channel 50 about the circumferential periphery of the first end 22 of the sleeve 20. The circumferential channel 50 has a constant cross-section with a constant channel gap 52 (FIG. 4).

Figure 7:
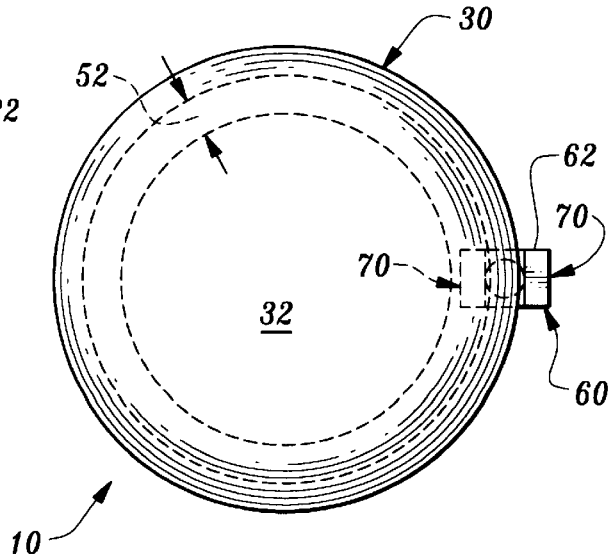
FIG. 7 is a top plan view of the installed cover with the latching lug engaged.
Figure 8:
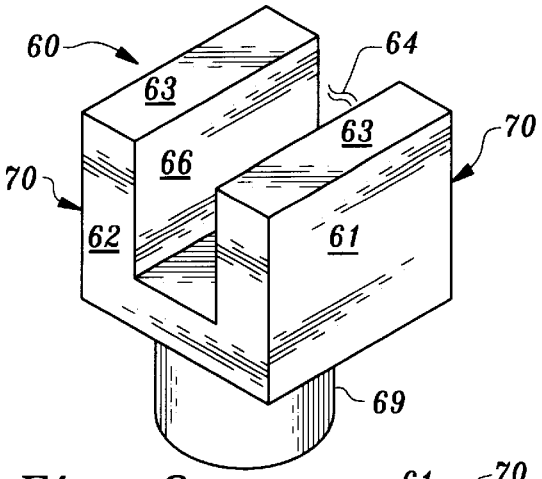
FIG. 8 is a perspective view of the latching lug of the present invention.
Figure 9:
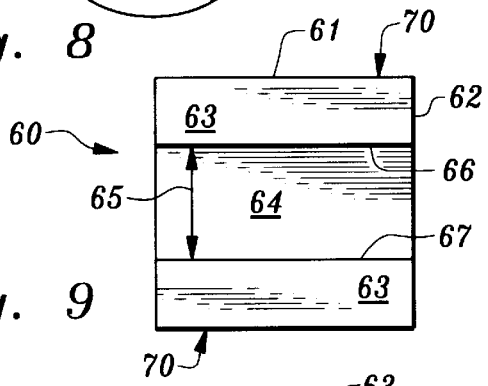
FIG. 9 is a top plan view of the latching lug.
Figure 10:
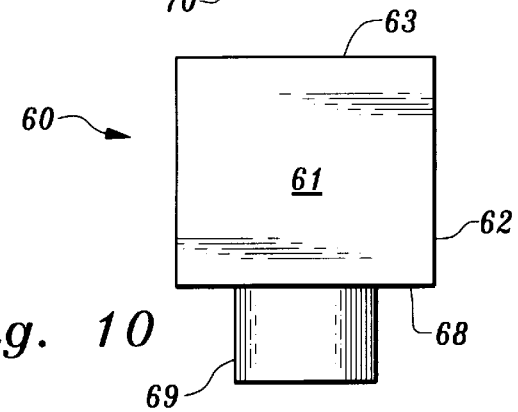
FIG. 10 is a side elevation view of the latching lug.
Figure 11:
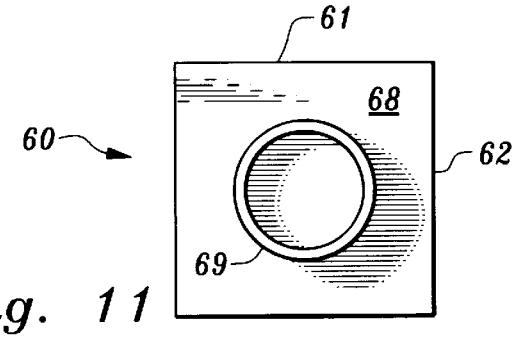
FIG. 11 is a bottom plan view of the latching lug.

As most clearly shown in FIGS. 8–11, the present invention also includes a separate generally box-shaped latching lug 60 which releasably engages the latching profile (FIGS. 5–7) of the inverted ridge 40 and channel 50 on the lip 35 of the cap portion 30. The latching lug 60 of the present invention provides one form of a means to releasably engage the lip 35 of the cap portion 30 of the cover 10. Other means include: a spring-loaded jaw (FIG. 12) which grips a generally horizontal flat lip 35 of the cap portion 30 of the cover 10; a hook which engages a resilient loop of cord attached to the cover 10; a magnetic appendage which magnetically engages a corresponding magnetically-attractive portion of the cover 10; and a latching lug such as that described herein, but including a detente mechanism with spring-loaded spheres to protrude and engage a reciprocal profile within the inverted ridge 40 and channel 50.

The latching lug 60 includes an upper mating surface 63 and a lower connecting surface 68. Two substantially equivalent opposing parallel vertical sides 61 are joined at right angles to two substantially equivalent opposing parallel vertical ends 62 to form the perimeter vertical walls of the latching lug 60. A preferably cylindrical female connector 69 extends from the lower connecting surface 68 of the latching lug 60. The female connector 69 provides one form of a means to secure the latching lug 60 to an end of a telescoping pole 80. Other means could include structures such as threaded connections, articulable connections, rigid pinned connections and welded connections.

A rectangular groove 64 (FIG. 9) bisects the upper mating surface 63 of the latching lug 60 to form two prongs 70. The groove 64 has a transverse span 65 which is just slightly wider than the planar crest 42 of the inverted ridge 40. The groove 64 includes two substantially equivalent vertical longitudinal walls 66, 67. The span 65 and walls 66, 67 of the groove 64 are sized to mate snugly with the distending profile of the inverted ridge 40. Each prong 70 is sized and shaped to snugly mate within the channel 50 of the cap portion 30 of the cover 10.

As most clearly shown in FIG. 6 in use, when the latching lug 60 is releasably engaged with the inverted ridge 40 and channel 50, the outboard wall 67 of the groove 64 of the latching lug 60 rests adjacent the inverted ridge 40. An opposing inboard wall 66 of the groove 64 simultaneously rests adjacent the interior wall 49 of the inverted ridge 40. Thus engaged, the depth of the inverted ridge 40 is preferably substantially slidably received within the groove 64 of the latching lug 60.

Concurrently, a portion of the upper mating surface 63 of the latching lug 60 nearest the exterior surface 24 of the peripheral wall 26 of the sleeve 20 preferably rests adjacent the lower surface 36 of the lip 35 within the gap 52 of the channel 50. Thus mated, the inverted ridge 40 is securely received within the groove 64 of the latching lug 60 and an inboard prong 70 of the latching lug 60 is securely received within the channel 50. The clearance between these various members 40, 50, 64, 70 is preferably minimal to avoid any point-loading which might tend to fracture the latching lug 60 or the inverted ridge 40. The clearances between these members 40, 50, 50, 64 should be sufficient to allow the latching lug 60 to easily slidably engage with, and disengage from, the latching profile of the inverted ridge 40 and channel 50.

As shown in FIG. 5, the telescoping pole 80 provides one form of a means to move, raise or lower the cover 10 during installation or removal. Other means include a one-piece pole. The telescoping pole 80 includes a handle 82 at a handle end and an opposing distal end 84. A male connector 76 (FIG. 6) affixed to the distal end 84 of the pole 80 is sized to receive and mate with the female connector 69 (FIG. 8) of the latching lug 60. The telescoping pole 80 is preferably comprised of the handle 82 mated to a plurality of subsequent pole sections 86. Each pole section 86 is sized to fit within and slidably engage an earlier pole section 86 nearer the handle 82 of the pole 80. Each pole section 86 is sized to receive and slidably engage a later pole section 86 nearer the distal end 84 of the pole 80.

Figure 12:
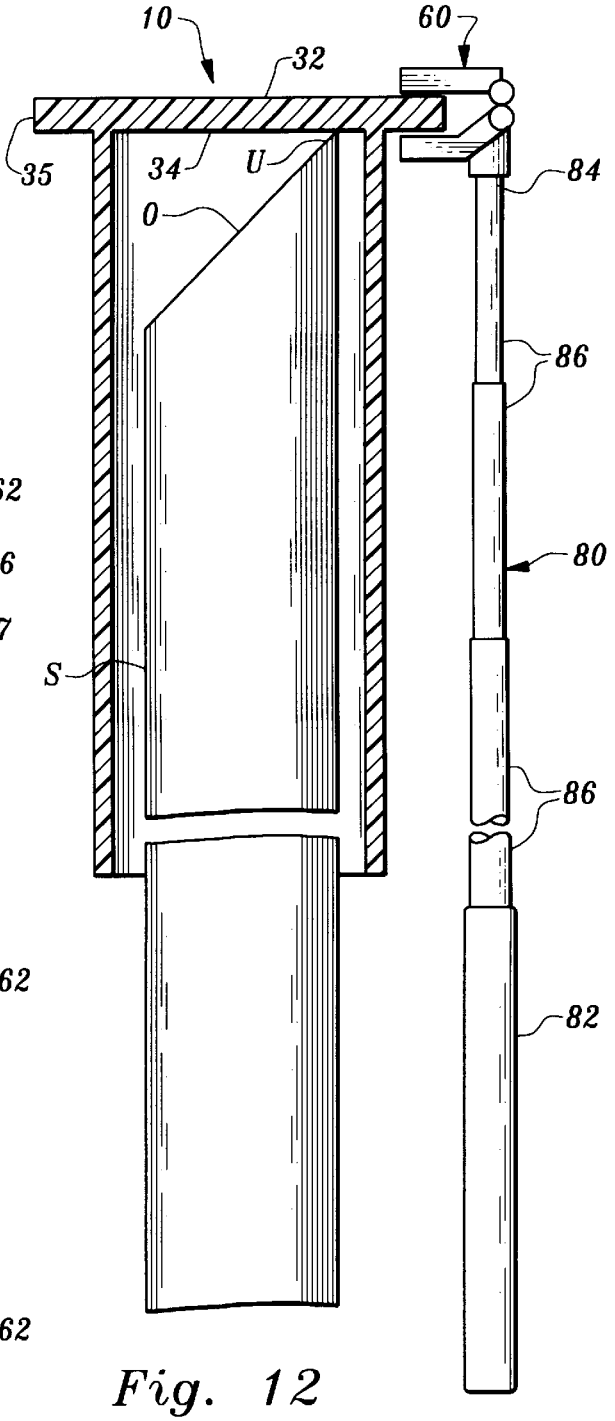
FIG. 12 is a side cross-sectional view of an alternative embodiment of the present invention.

FIG. 12 reveals an alternative embodiment of the cover 10 and telescoping pole 80. Specifically, the roof 32 can be flat and horizontal and extending beyond a width of the other portions of the cover 10 in the form of the lip 35. This lip 35, because it extends horizontally, requires that the latching lug 60 of the telescoping pole 80 be angled to interface with the lip 35 in contrast to the lug 60 of the preferred embodiment revealed in FIG. 5. If desired, the latching lug 60 of this alternative embodiment in FIG. 12 can be configured to pivot relative to each other to grasp the lip 35. The means to cause the latching lug 60 to have its separate prongs pivot can be operable from the handle 82 of the telescoping pole 80 by the user, such as a separate actuating cable and rod or can be in the form of high friction pivot joints which can cause the latching lug 60 to hold onto the lip 35 except when a high level of force is applied to the latching lug 60, such as by pulling down sharply on the telescoping pole 80 after the cover 10 is in place upon the exhaust stack S.

In use and operation, the prongs 70 (FIG. 6) of the latching lug 60 on the telescoping pole 80 are first engaged with the inverted ridge 40 and channel 50 of the cover 10. During installation on the exhaust stack S, with the latching lug 60 engaged, the telescoping pole 80 is extended sufficiently to place the second open end 23 of the sleeve 20 over the exhaust outlet O at the upper end U of the exhaust stack S (FIG. 5). The cover 10 is then lowered over and onto the exhaust stack S until it can descend no further with the upper end U of the exhaust stack S adjacent the ceiling 34 of the cap portion 30 of the cover 10. The latching lug 60 is then disengaged from the cover 10 by simply pulling downward on the telescoping pole 80.

To remove the cover 10 from the exhaust stack S, the telescoping pole 80 is extended until the groove 64 of the latching lug 60 fully engages the ridge 40 on the lip 35 of the cover 10. Once engaged, the telescoping pole 80 is further extended or raised to lift the cover 10 off the exhaust stack S.

Preferably, the weight of the cover 10 provides sufficient downward force on the cover 10 to retain the cover 10 in place over the upper end U of the exhaust stack S. The weight of the cover 10 provides one form of a means of applying force to the cover 10 to keep it securely in place on the exhaust stack S. Other means include: a resilient elastic cord attached to a fixed point on the cover 10 with another end releasably attached to a point adjacent the exhaust stack S; magnetically-engaging strips attached to the inner surface 25 of the sleeve 20 which magnetically secure the cover 10 to the metal exterior of the exhaust stack S; and, other internal gripping mechanisms, such as springs, which frictionally engage and grip the exterior of the exhaust stack S.

This disclosure is provided to reveal a preferred embodiment of the invention and a best mode for practicing the invention. Having thus described the invention in this way, it should be apparent that various different modifications can be made to the preferred embodiment without departing from the scope and fair meaning of this disclosure. When structures are identified as a means to perform a function, the identification is intended to include all structures which can perform the function specified.

What is claimed is:

1. A cover for an outlet of a vertically-oriented exhaust stack, said cover comprising in combination:

a cylindrical sleeve;

said cylindrical sleeve including an open end;

said open end having sufficient size to slidably fit over the exhaust stack;

said cylindrical sleeve including a cap portion;

said sleeve and said cap portion forming a closed end of said sleeve opposite said open end of said sleeve;

means to elevate and lower said cover relative to the outlet of the exhaust stack; and wherein said cap portion includes a radially-extending lip.

2. A cover for an outlet of a vertically-oriented exhaust stack, said cover comprising in combination:

a cylindrical sleeve;

said cylindrical sleeve including an open end;

said open end having sufficient size to slidably fit over the exhaust stack;

said cylindrical sleeve including a cap portion;

said sleeve and said cap portion forming a closed end of said sleeve opposite said open end of said sleeve;

means to elevate and lower said cover relative to the outlet of the exhaust stack;

wherein said elevating and lowering means includes a means to releasably engage said cover; and wherein said means to releasably engage said cover includes a latching lug secured to an end of said elevating and lowering means.

3. The cover of claim 1 wherein said lip includes a ring extending down from a periphery of said lip.

4. The cover of claim 3 wherein said peripheral ring has a substantially rectangular cross-section.

5. A cover and vertically-oriented exhaust pipe combination for protecting an upper end of the exhaust pipe when not in use, the combination comprising:

an elongate tubular exhaust pipe having an open upper end with a central axis oriented closer to vertical than to horizontal at said open upper end;

a cover including a peripheral wall surrounding a central region laterally and means to substantially enclose an upper side of said central region, said central region at least as large as said open upper end of said exhaust pipe;

means for a user to move said cover relative to said open upper end of said exhaust pipe while the user is located beyond reach of said cover;

wherein said covering moving means includes an elongate pole; and wherein said cover has a lip extending radially from said peripheral wall and said pole has a tip at a distal end opposite a handle end, said tip including means to engage said lip.

* * * * *